US005431301A

United States Patent [19]

Suzuki et al.

[11] Patent Number: 5,431,301

[45] Date of Patent: Jul. 11, 1995

[54] HOPPER TYPE SUPPLY DEVICE FOR ROD MEMBERS

[75] Inventors: Minoru Suzuki; Takayuki Irikura, both of Tokyo, Japan

[73] Assignee: Japan Tobacco Inc., Tokyo, Japan

[21] Appl. No.: 138,019

[22] Filed: Oct. 19, 1993

[30] Foreign Application Priority Data

Oct. 22, 1992 [JP] Japan ..... 4-284309

[51] Int. Cl.[6] ..... B65H 3/62; B65H 3/64

[52] U.S. Cl. ..... 221/203; 221/277; 221/211; 221/257; 221/265

[58] Field of Search ..... 131/282, 283; 198/533, 198/347.1, 347.2, 347.3, 455; 221/200, 203, 277, 211, 244, 254, 256, 257, 263, 264, 265

[56] References Cited

U.S. PATENT DOCUMENTS

| | | | |
|---|---|---|---|
| 3,485,208 | 12/1969 | Hemming et al. | 131/282 X |
| 4,368,742 | 1/1983 | Wahle et al. | 198/347.2 X |
| 4,615,169 | 10/1986 | Würmli | 221/203 X |
| 4,741,428 | 5/1988 | Taniguchi et al. | 221/200 X |
| 4,763,775 | 8/1988 | Jefferys et al. | 221/200 X |
| 4,795,019 | 1/1989 | Spada et al. | 198/347.2 |
| 5,220,992 | 6/1993 | Milins | 131/282 X |

FOREIGN PATENT DOCUMENTS

| | | |
|---|---|---|
| 1556693 | 2/1968 | Germany . |
| 2250267 | 4/1974 | Germany . |
| 3540779 | 6/1986 | Germany . |
| 2070546 | 9/1981 | United Kingdom . |

*Primary Examiner*—William E. Terrell
*Assistant Examiner*—Dean A. Reichard
*Attorney, Agent, or Firm*—Birch, Stewart, Kolasch & Birch

[57] ABSTRACT

A hopper type supply device includes a rod hopper for storing a large number of filter rods. A grooved hopper drum rotatably disposed directly under the rod hopper is provided for closing the discharging port of the rod hopper. A roller is rotatably disposed near the discharging port in the rod hopper and rotated in a direction opposite to the rotating direction of the hopper drum, for accelerating the filter rods lying near the roller by rotation thereof. The hopper drum takes out the filter rods received into the receiving grooves from the rod hopper according to the rotation thereof.

13 Claims, 3 Drawing Sheets

HOPPER TYPE SUPPLY DEVICE FOR ROD MEMBERS

BACKGROUND OF THE INVENTION

1. Field of the Invention

This invention relates to a hopper type supply device for supplying filter rods as rod members in the manufacturing process of filter cigarettes, for example.

2. Description of the Related Art

With a filter cigarette manufacturing apparatus which is a so-called filter attachment, a filter plug which is obtained by cutting a filter rod is first disposed between two cigarettes. The two cigarettes and the filter plug are combined together by use of a sheet of paper to make two connected filter cigarettes, and then, the two connected filter cigarettes are cut apart at the center of the filter plug to make two separated filter cigarettes.

Therefore, a hopper type supply device for supplying filter rods is attached to the filter attachment. The supply device includes a hopper for storing a large number of filter rods and a receiving drum disposed directly under the discharging port of the hopper, and the discharging port is shut or closed by part of the peripheral surface, that is, the circular arc wall of the receiving drum.

A large number of receiving grooves are formed in the peripheral surface of the receiving drum and the receiving grooves are arranged at a regular interval in the circumferential direction of the receiving drum.

The filter rod has a length corresponding to the length of a plurality of filter plugs and the filter rods in the hopper are arranged with the axes thereof set in the direction along the receiving grooves.

Therefore, the filter rods in the hopper are set into the respective receiving grooves of the circular arc wall via the discharging port.

If, in this state, the receiving drum is rotated in one direction, the filter rods in the respective receiving grooves of the receiving drum are sequentially taken out from the hopper.

The thus taken-out filter rod is cut into two or three equal portions on the receiving drum to form separate filter plugs and the filter plugs are supplied towards the cigarette feeding path.

In order to enhance the productivity of filter cigarettes, it is required to enhance the whole operation speed of the filter attachment. Therefore, in the above-described hopper type supply device, it is necessary to enhance the peripheral speed of the receiving drum in order to increase the number of filter rods which can be taken out for each unit of time.

However, if the peripheral speed of the receiving drum, that is, the moving speed of the receiving groove is made high, each of the receiving grooves which successively pass in the hopper according to the rotation of the receiving drum cannot stably receive the filter rod, and as a result, it becomes impossible to successively take out the filter rods from the hopper. This may be considered to occur by the following two causes. The first cause is that the flow of the filter rods in the hopper cannot follow the moving speed of the receiving groove. The second cause is that a bridge is constructed by a plurality of filter rods near the receiving drum and the bridge disturbs the flow of the filter rods moving towards the receiving drum.

As will be clearly understood from the above explanation, since two or three filter plugs are obtained from the filter rod received into one of the receiving grooves of the receiving drum, each filter rod is used for forming four or six filter cigarettes. Therefore, if the receiving groove of the receiving drum fails to receive the filter rod in the hopper, the number of filter cigarettes which become defective is increased, thus significantly lowering the productivity of the filter cigarettes.

SUMMARY OF THE INVENTION

An object of this invention is to provide a hopper type supply device in which each of the receiving grooves of the receiving drum can stably receive a rod member in the hopper even if the peripheral speed of the receiving drum is high, and as a result, rod members can be successively taken out from the hopper.

The above object can be attained by a hopper type supply device which comprises a hopper for storing a large number of rod members and having a discharging port for discharging the rod members in a downward direction, the rod members in the hopper being set in a preset direction; a receiving drum disposed directly under the hopper and having a peripheral surface part of which closes the discharging port and a large number of receiving grooves separately formed on the peripheral surface in a circumferential direction of the receiving drum to receive rod members one by one, the rod members received into the receiving grooves being successively taken out from the hopper with the rotation of the receiving drum; and means for agitating the rod members lying on the discharging port side of the hopper.

According to the above supply device, the means is used to agitate the rod members lying near the discharging port in the hopper and prevents the formation of a bridge by the rod members in the hopper. As a result, the rod members in the hopper can be smoothly guided into the receiving grooves via the discharging port and each rod member can be set into one of the receiving grooves.

In a case where the hopper has a pair of inner walls defining the width of the opening of the discharging port in the rotating direction of the receiving drum, the means includes an accelerating roller disposed between the pair of inner walls in the hopper and the accelerating roller is rotated in a direction opposite to the rotating direction of the receiving drum. Preferably, the accelerating roller is arranged on the first inner wall side among the pair of inner walls which lies on the upstream side in the rotating direction of the receiving drum.

In this case, the first inner wall and the peripheral surface part of the receiving drum cooperate with the accelerating roller to define a flow path for the rod members, and in the flow path, it is preferable to set the width of the flow path between the accelerating roller and the peripheral surface part of the receiving drum smaller than the width of the flow path between the first inner wall and the accelerating roller.

With the above supply device, when the accelerating roller disposed near the receiving drum is rotated, the accelerating roller agitates the rod members lying around the accelerating roller. Therefore, even if a bridge is constructed by the rod members near the receiving drum, the bridge is immediately broken. As a result, rod members falling down near the accelerating roller are moved towards the receiving drum as a uniform layer form flow.

Since the rotating direction of the accelerating roller is opposite to that of the receiving drum, the rotation of the accelerating roller causes the rod members lying between the accelerating roller and the receiving drum to move along the rotating direction of the receiving drum and accelerate the movement towards the receiving drum.

Therefore, when the receiving grooves of the receiving drum pass the discharging port of the hopper, rod members are forcedly pushed into the receiving grooves, thereby making it possible for the receiving grooves to stably receive the rod members.

It is preferable to shut or close a gap between the other inner wall and the receiving drum by use of a blocking roller from the exterior of the hopper and rotate the blocking roller in the same direction as the receiving drum.

Rod members which tend to move into the above gap according to the rotation of the receiving drum are pushed back into the hopper by rotation of the blocking roller, thus preventing the rod members from becoming fixedly set into the above gap.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
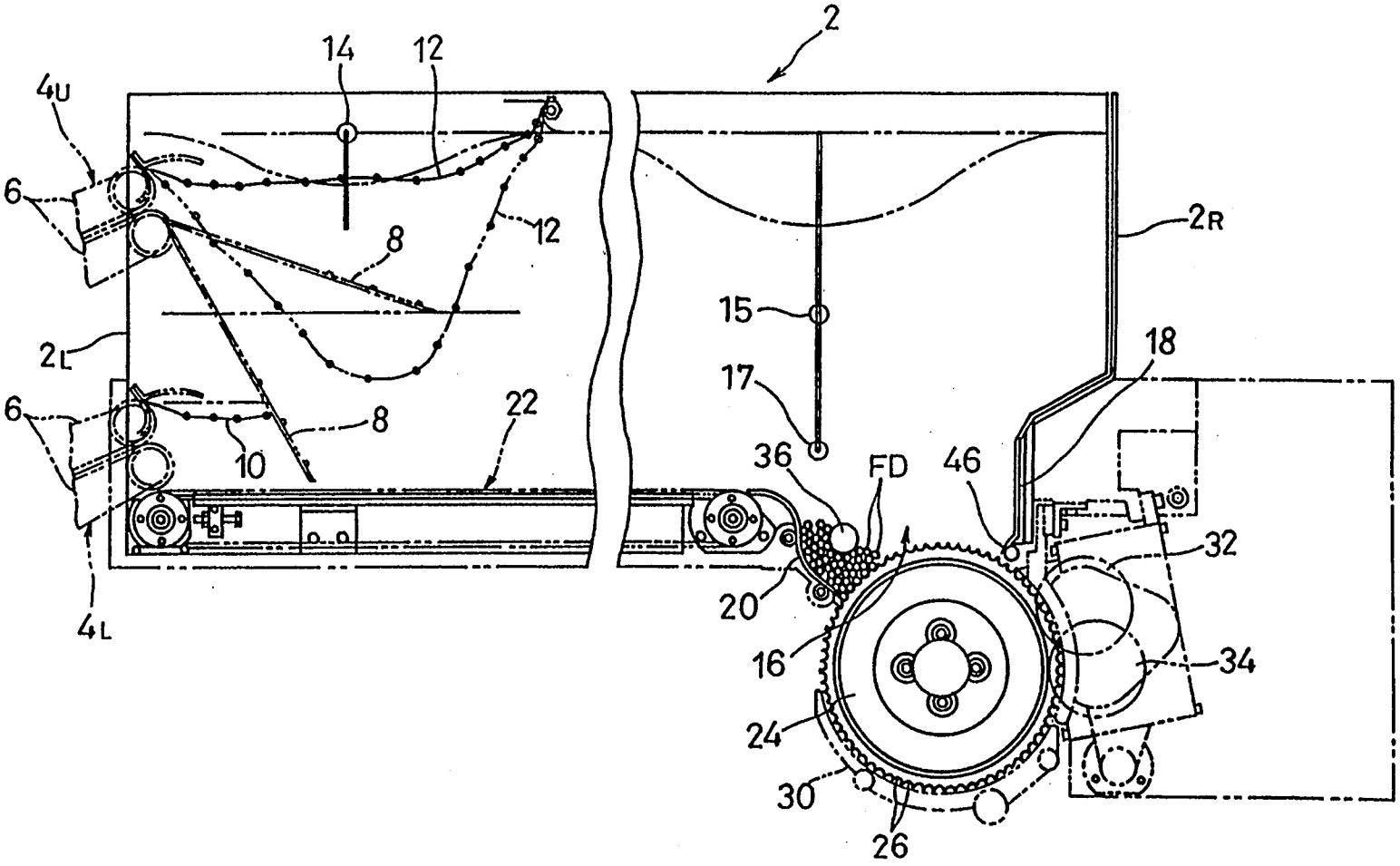
FIG. 1 is a schematic front view showing a hopper type supply device for filter rods.

A hopper type supply device shown in FIG. 1 is incorporated as part of the filter attachment and includes a rod hopper 2. The rod hopper 2 is formed in a box form extending in a horizontal direction. A large number of filter rods FD are stored as rod members in the rod hopper 2. Therefore, the depth of the rod hopper 2 is determined according to the length of the filter rod FD.

The filter rod FD is cut apart into filter plugs which are then used to form filter cigarettes. Therefore, the filter rod FD has a length which is two or more times the length of the filter plug.

In FIG. 1, a pair of rod feeders $4_U$, $4_L$ are connected to the left-end wall $2_L$ of the rod hopper 2 in the upper and lower positions. The rod feeders $4_U$, $4_L$ are used to successively feed the filter rods FD into the rod hopper 2. More specifically, each rod feeder 4 includes a pair of upper and lower belt conveyers 6. The belt conveyers 6 are disposed with inclination and one-side ends, that is, the upper ends thereof project into the rod hopper 2. A space between the pair of belt conveyers 6 defines a feed path for the filter rods FD.

A conveyer tube (not shown) for the filter rods FD is connected to the lower end of each of the feed paths and extends in a direction perpendicular to the feed path. Each of the conveyer tubes feeds the filter rods FD in the axial direction thereof by the air flow and successively guides the filter rods FD to the lower end of a corresponding feed path. The filter rod FD reaching the lower end of the feed path is guided into the feed path by the movement of the pair of belt conveyers 6 and supplied into the hopper 2 via the feed path.

Therefore, the filter rods FD transferred from the conveyer tube to the feed path are guided in a direction perpendicular to the axial line thereof in the feed path and supplied into the rod hopper 2, and as a result, the filter rods FD in the rod hopper 2 are arranged in the same direction, that is, they are stored with the axial lines thereof set in a direction perpendicular to the drawing of FIG. 1.

A rocking plate 8 extends from the upper end of the rod feeder $4_U$ towards the interior of the rod hopper 2 and is mounted to move in the vertical direction according to a fluctuation in the storage amount of the filter rods FD supplied from the rod feeder $4_L$.

Further, a roller chain 10 extends from the upper end of the rod feeder $4_L$ and the front end of the roller chain 10 is a free end. A roller chain 12 is stretched between the upper end of the rod feeder $4_U$ and the right-end wall $2_R$ of the rod hopper 2. The roller chain 12 lightly suppresses the filter rods FD to prevent disturbance of the filter rods FD when the filter rods FD stored in the rod hopper 2 are fed by means of a hopper conveyer which will be described later. Further, when the amount of the filter rods FD in the rod hopper 2 has exceeded a permissible amount, the roller chain 12 turns ON a full amount detection sensor 14 so as to interrupt the supply of the filter rods FD from the pair of rod feeders 4 to the rod hopper 2.

In FIG. 1, the bottom wall of the rod hopper 2 has a rectangular discharging port 16 protruding in a downward direction in the right corner. The width of the opening of the discharging port 16 is defined between a side wall 18 extending downwardly from the right-end wall $2_R$ of the rod hopper 2 and a side wall 20 extending downwardly from the bottom wall in opposition to the side wall 18.

An opening is formed in an area of the bottom wall of the rod hopper 2 extending from a portion near the discharging port 16 to the rod feeder $4_L$ and is closed by a belt type hopper conveyer 22. Therefore, the hopper conveyer 22 is used as a movable bottom wall which travels from the rod feeder $4_L$ towards the discharging port 16 so that the filter rods FD put into the rod hopper 2 can be fed to the discharging port 16 according to the movement of the movable bottom wall or the hopper conveyer 22.

When the roller chain 12 turns ON or OFF the supplementary sensor 15, the driving operation of the hopper conveyer 22 is controlled. That is, when the roller chain 12 is lowered to a position below the supplementary sensor 15, the supplementary sensor 15 is turned ON and the driving operation of the hopper conveyer 22 is started. As a result, the filter rods FD in the rod hopper 2 are fed towards the discharging port 16. In contrast, when the roller chain 12 is raised to a position above the supplementary sensor 15, the supplementary sensor 15 is turned OFF and the driving operation of the hopper conveyer 22 is stopped. Therefore, a preset amount of filter rods FD are always provided on the side of the discharging port 16 of the rod hopper 2.

A lower limit sensor 17 is disposed below the supplementary sensor 15 and is also turned ON or OFF by the roller chain 12. When the roller chain 12 is lowered to a position below the lower limit sensor 17 and the lower limit sensor 17 is turned ON, it is determined that supply of the filter rods FD into the rod hopper 2 is abnormal and the operations of the filter attachment and the supply device are interrupted by the ON signal of the lower limit sensor 17.

A hopper drum 24 used as a receiving drum is disposed directly under the discharging port 16. Part of the peripheral surface of the hopper drum 24 projects into the discharging port 16 so that the discharging port 16 may be closed by a circular arc wall constructed by part of the peripheral surface of the hopper drum 24.

The diameter of the hopper drum 24 is set to be sufficiently larger than the width of the opening of the discharging port 16 and a large number of receiving grooves 26 are formed in the peripheral surface of the hopper drum 24. The receiving grooves 26 are successively formed in the circumferential direction of the hopper drum 24.

Figure 2:
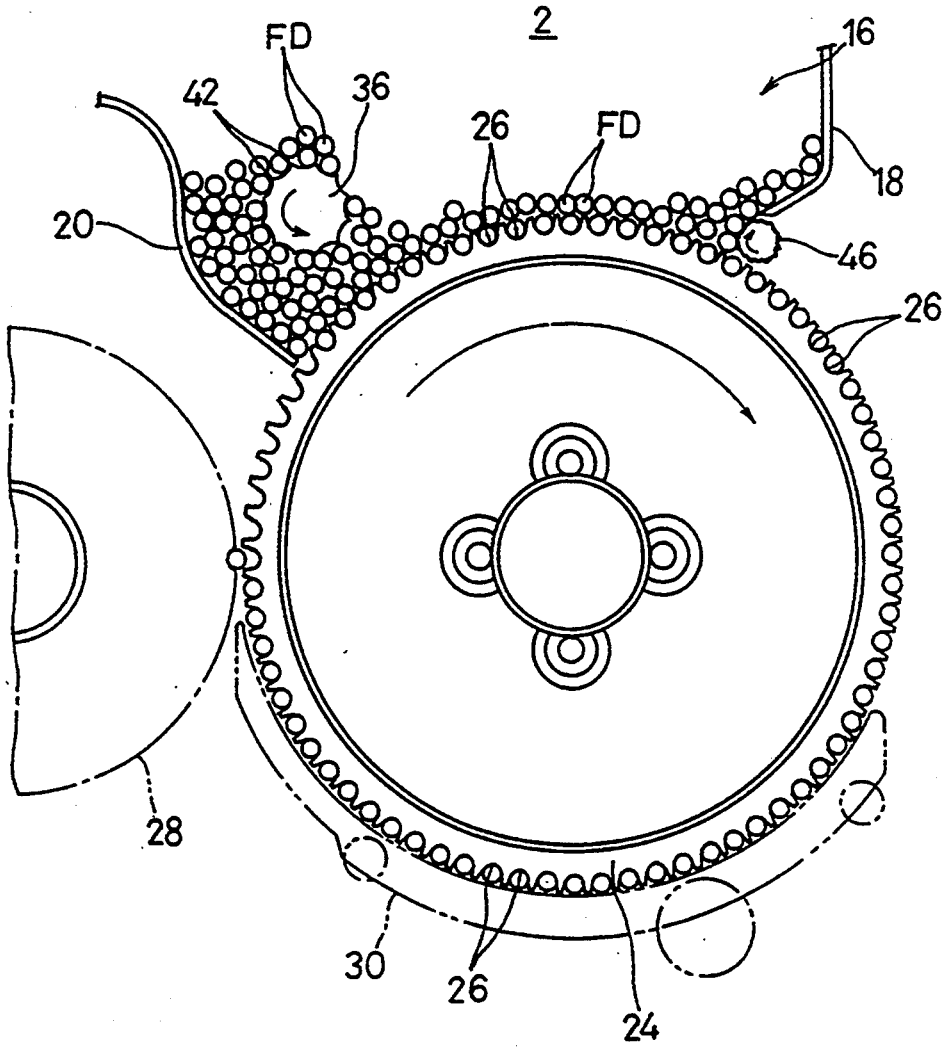
FIG. 2 is an enlarged view showing part of the supply device of FIG. 1.

The receiving grooves 26 of the hopper drum 24 be in the discharging port 16, that is, the receiving grooves 26 positioned on the circular arc of the hopper drum. 24 can receive the filter rods FD in the rod hopper 2 one by one as shown in FIG. 2.

Figure 3:
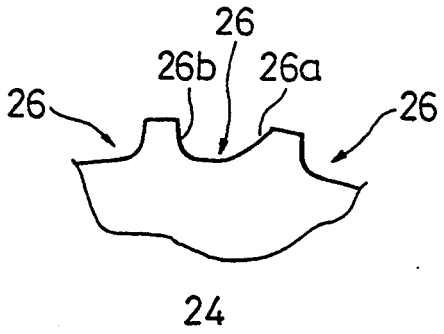
FIG. 3 is an enlarged view showing a part of the periphery of a hopper drum.

As is clearly understood from FIG. 3, a groove wall 26*a* which is one of a pair of groove walls defining the receiving groove 26 and which lies on the front side as viewed from the rotating direction of the hopper drum 24 is inclined to enlarge the width of the opening of the receiving groove 26 and the other groove wall 26*b* is formed along the radial direction of the hopper drum 24.

As shown in FIG. 2, when the hopper drum 24 is rotated in a clockwise direction (in a direction as indicated by an arrow in FIG. 2), the filter rods FD are taken out from the discharging port 16 with the receiving grooves 26 holding the filter rods FD. The thus taken-out filter rods FD are fed on the hopper drum 24 according to the rotation of the hopper drum 24.

After this, the filter rods FD are fed towards a feeding path (not shown) of the cigarettes while being sequentially transferred from the hopper drum 24 to a drum train which is constructed by the series of grooved drums and connects between the hopper drum 24 and the feeding path of the cigarettes. In FIG. 2, part of one grooved drum 28 which is disposed at the first stage of the drum train is shown.

Transfer of the filter rods FD from the hopper drum 24 to the grooved drum 28 and transfer of the filter rods FD from one of the grooved drum of the drum series to the next grooved drum are effected by drawing or sucking the filter rod FD from the preceding stage drum towards the next stage drum.

When the receiving grooves 26 of the hopper drum 24 lie in the discharging port 16, the receiving grooves 26 are connected to a suction source which is not shown in the drawing. The sucking area is set in an area inside the discharging port 16 and also in a preset angle range from the discharging port 16.

Therefore, the filter rods FD lying in the discharging port 16 are forcefully received into the receiving grooves 26 by the suction action. Further, when a receiving groove 26 lies in the suction area, the filter rod FD is held in the receiving groove by the suction force.

The lower half portion of the peripheral surface of the hopper drum 24 is covered with a guide 30 disposed below the drum 24. The guide 30 functions to prevent the filter rods FD from falling from the receiving grooves 26 when the operation of the supply device is interrupted and supply of the suction force by the suction source is interrupted.

Further, as is schematically shown in FIG. 1, a pair of circular knives 32, 34 are disposed outside the hopper drum 24 and are arranged in this order in the rotating direction of the hopper drum 24. The circular knives 32, 34 are rotated with part of the blade edge thereof set in the peripheral groove (not shown) of the hopper drum 24 and the invasion depth of the blade edge is set to be larger than the depth of the receiving groove 26.

After the filter rod FD in the receiving groove 26 passes the circular knives 32, 34 according to the rotation of the hopper drum 24, it is cut into three equal portions to form filter plugs. Therefore, when the filter rod FD is transferred from the hopper drum 24 to the grooved drum 28, it is already separated into three filter plugs.

The three filter plugs transferred to the grooved drum 28 and lying in one groove are re-arranged in the feeding direction while they are being fed along the drum train, supplied one by one to the cigarette feeding path from the grooved drum lying at the final stage of the drum train and each placed between two cigarettes. The cigarette feeding path is also constructed by a drum train having a large number of grooved drums.

After this, the two cigarettes and one filter plug are fed towards the rolling section of the filter attachment and combined together by a paper sheet in the rolling section to form two filter cigarettes.

In the rod hopper 2, an accelerating roller 36 having a smaller diameter than the hopper drum 24 is disposed near the discharging port 16. More specifically, the agitator roller 36 is disposed near the side wall 20 of the rod hopper 2 and the hopper drum 24.

A distance between the accelerating roller 36 and the circular arc wall of the hopper drum 24 is set to be equal to the total length of the diameters of three filter rods FD, for example. Further, a distance between the accelerating roller 36 and the side wall 20 is set to a value equal to the total length of the diameters of four filter rods FD, for example.

As is clearly seen from FIG. 2, a portion of the side wall 20 which faces the peripheral surface of the accelerating roller 36 is bent to project outwardly. The lower end portion of the side wall 20 lies on a line extending in the radial direction of the hopper drum 24 and passing the axial center thereof and is disposed near the peripheral surface of the hopper drum 24.

Figure 4:
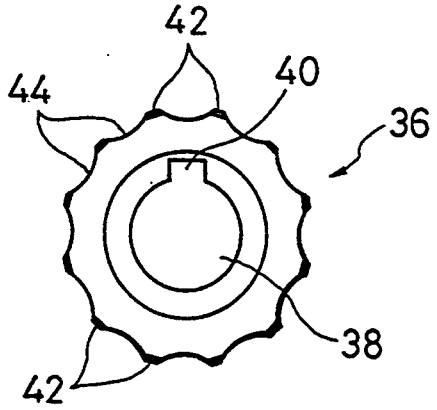
FIG. 4 is an enlarged front view showing an accelerating roller of FIG. 2.

As shown in FIG. 4, the accelerating roller 36 has a hole 38 formed in the center portion thereof to receive a roller shaft (not shown) and a key groove 40 is formed in the inner surface of the hole 38. Thus, the accelerating roller 36 and the roller shaft can be combined together by use of a key (not shown).

On the peripheral surface of the accelerating roller 36, twelve projections 42 are formed at a regular interval in the circumferential direction thereof. The projections 42 extend in the axial direction of the accelerating roller 36 and the thickness thereof is set to be sufficiently smaller than the diameter of the filter rod FD.

A portion between the adjacent projections 42 forms a concave surface 44 in the peripheral surface of the accelerating roller 36 and the radius of curvature of the concave surface 44 is set to be slightly larger than the radius of the filter rod FD.

The accelerating roller 36 is rotated in a counterclockwise direction as viewed in FIG. 2 and the peripheral speed thereof is set equal to or slightly higher than the peripheral speed of the hopper drum 24.

Although the driving systems for the hopper drum 24 and the accelerating roller 36 are not shown in the drawing, the hopper drum 24 is rotated in connection with the accelerating roller 36. More specifically, the drum shaft of the hopper drum 24 and the roller shaft of the accelerating roller 36 are connected with each other via a gear train.

Further, a gap between the lower end of the side wall 18 of the rod hopper 2 and the peripheral surface of the hopper drum 24 is closed by a refusing roller 46. The member 46 is a small-diameter roller having knurl formed in the peripheral surface and is rotated in connection with the hopper drum 24 in the same direction as the rotating direction of the hopper drum 24, that is, in the clockwise direction in FIG. 2 at a preset peripheral speed.

The refusing roller 46 has not only a function of preventing the filter rods FD from being inserted into a gap between the lower end of the side wall 18 and the hopper drum 24 but also a function of pushing up the filter rods FD lying near the above gap by the rotation thereof.

If the accelerating roller 36 is arranged near the discharging port 16, the accelerating roller 36 agitates the filter rods FD lying near the roller by the projections 42 formed on the peripheral surface thereof with the rotation of the accelerating roller. Therefore, a bridge phenomenon of the filter rods FD will not occur near the hopper drum 24 and the filter rods FD in the discharging port 16 are guided as a uniform flow towards the peripheral surface of the hopper drum 24.

A flow path for the filter rods FD is defined between the accelerating roller 36 and the wall surface including the side wall 20 of the discharging port 16 and the peripheral surface or the circular arc surface of the hopper drum 24, and the width of the flow path becomes smaller in a portion closer to the hopper drum 24 as described before. That is, a distance between the accelerating roller 36 and the bent portion of the side wall 20 is set to a value equal to the total length of the diameters of four filter rods FD, but a distance between the accelerating roller 36 and the hopper drum 24 is set to be equal to the total length of the diameters of only three filter rods FD, for example.

Therefore, when the filter rods FD flow towards the hopper drum 24 in the above flow path, rotation of the accelerating roller 36 accelerates the flow of the filter rods FD and moves the filter rods to the hopper drum 24.

Therefore, even if the rotating speed of the hopper drum 24 becomes high, the filter rods FD are forcefully pushed down into the respective receiving grooves 26 when the receiving grooves 26 pass the discharging port 16, and thus the receiving grooves 26 can stably receive the filter rods FD. As a result, the filter rods FD are successively taken out from the rod hopper 2 and fed towards the cigarette feeding path as described before.

Figure 5:
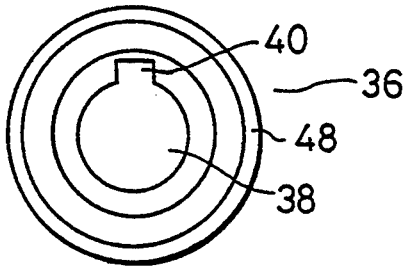
FIG. 5 is a front view showing another accelerating roller.

This invention is not limited to the above embodiment and can be variously modified. For example, as shown in FIG. 5, the accelerating roller 36 has a rubber layer 48 having a large friction coefficient and formed on the peripheral surface instead of a plurality of projections 42. With the accelerating roller 36 of FIG. 5, the filter rods FD can be efficiently accelerated by the rotation thereof.

Further, in the above embodiment, a distance between the accelerating roller 36 and the side wall 20 is set to be larger than a distance between the accelerating roller 36 and the hopper drum 24 by a length corresponding to the diameter of one filter rod FD, but the difference between the two distances may be set to a value corresponding to the total length of the diameters of two filter rods FD, for example.

This invention is applied to a hopper type supply device incorporated into a filter attachment, but it can be applied to a hopper type supply device dealing with various types of rod members other than the filter rods for cigarettes.

What is claimed is:

1. A hopper type supply device comprising:

a hopper for storing a large number of rod members and having a discharging port for discharging the rod members in a downward direction, the rod members in said hopper being set in a preset direction;

a receiving drum rotatably disposed directly under said hopper and having a peripheral surface part for closing said discharging port and receiving grooves separately formed on the peripheral surface in a circumferential direction of said receiving drum to receive rod members one by one, the rod members received into the receiving grooves being successively taken out from said hopper while said receiving drum rotates in one direction; and means for producing a forced flow of rod members toward said receiving drum in said hopper, wherein said hopper has first and second inner walls defining a width of an opening of said discharging port in the rotating direction of said receiving drum, the first inner wall being located on an upstream side of the rotating direction of said receiving drum with respect to the second inner wall, and said means includes a roller rotatably disposed on the side of the first inner wall in the discharge port so that the first inner wall and the peripheral surface of said receiving drum which closes said discharging port are cooperated with said roller to define a flow path for rod members, said roller being rotated in a direction opposite to the rotating direction of said receiving drum for accelerating rod members in the flow path.

2. A device according to claim 1, wherein a width of the flow path between said roller and the peripheral surface of said receiving drum is made smaller than a width of the flow path between said first inner wall and said roller.

3. A device according to claim is 2, wherein said roller has a plurality of projections arranged at a regular interval in the circumferential direction on the peripheral surface of said roller.

4. A device according to claim 2, wherein said roller has a rubber layer formed on the peripheral surface thereof.

5. A device according to claim 1, in which a gap is defined between said receiving drum and the second inner wall and which further comprises a blocking roller for closing said gap from an external side.

6. A device according to claim 5, wherein said blocking roller is rotated in the same direction as the rotating direction of said receiving drum.

7. A device according to claim 2, wherein said first inner wall has an end located close to the peripheral surface of said receiving drum, the end being lain on a line extending in a radial direction of said receiving drum.

8. A device according to claim 7, wherein said first inner wall has a bent portion extending along the peripheral surface of said roller to the end thereof.

9. A hopper type supply device comprising:

a hopper for storing a large number of rod members and having a discharging port for discharging the rod members in a downward direction, the rod members in said hopper being set in a preset direction;

a receiving drum rotatably disposed directly under said hopper and having a peripheral surface part for closing said discharging port and receiving grooves separately formed on the peripheral surface in a circumferential direction of said receiving drum to receive rod members one by one, the rod members received into the receiving grooves being successively taken out from said hopper while said receiving drum rotates in one direction; and means for producing a forced flow of rod members toward said receiving drum in said hopper;

said hopper includes first and second inner walls defining a width of an opening of said discharging port in the rotating direction of said receiving drum, the first inner wall being located on an upstream side of the rotating direction of said receiving drum with respect to the second inner wall, and said means includes a roller rotatably disposed on the side of the first inner wall in the discharge port so that the first inner wall and the peripheral surface of said receiving drum which closes said discharging port are cooperated with said roller to define a flow path for rod members, said roller being rotated in a direction opposite to the rotating direction of said receiving drum for accelerating rod members in the flow path;

a width of the flow path between said roller and the peripheral surface of said receiving drum being smaller relative to a width of the flow path between said first inner wall and said roller;

said roller including a rubber layer formed on the peripheral surface thereof.

10. A device according to claim 9, wherein said roller is an accelerating roller.

11. A device according to claim 9, wherein said roller has a plurality of projections arranged at a regular interval in the circumferential direction on the peripheral surface of said roller.

12. A device according to claim 9, in which a gap is defined between said receiving drum and the second inner wall and which further comprises a blocking roller for closing said gap from an external side.

13. A device according to claim 12, wherein said blocking roller is rotated in the same direction as the rotating direction of said receiving drum.

* * * * *